US009273921B2

(12) United States Patent
Koch

(10) Patent No.: US 9,273,921 B2
(45) Date of Patent: Mar. 1, 2016

(54) ARCHERY BOW, FLOATING LIMB COMPOUND (FLC)

(71) Applicant: Eric William Koch, De Soto, WI (US)

(72) Inventor: Eric William Koch, De Soto, WI (US)

( * ) Notice: Subject to any disclaimer, the term of this patent is extended or adjusted under 35 U.S.C. 154(b) by 0 days.

(21) Appl. No.: 13/902,454

(22) Filed: May 24, 2013

(65) Prior Publication Data

US 2014/0360480 A1 Dec. 11, 2014

Related U.S. Application Data

(60) Provisional application No. 61/688,848, filed on May 23, 2012.

(51) Int. Cl.
*F41B 5/10* (2006.01)

(52) U.S. Cl.
CPC ..... *F41B 5/10* (2013.01)

(58) Field of Classification Search
CPC ..... F41B 5/10
USPC ..... 124/25.6, 86, 88
See application file for complete search history.

(56) References Cited

U.S. PATENT DOCUMENTS 3,967,609 A * 7/1976 Frydenlund ..... 124/25.6
4,078,538 A * 3/1978 Shepley ..... 124/25.6
4,455,990 A * 6/1984 Barna ..... 124/86
4,858,588 A * 8/1989 Bozek ..... 124/23.1
5,638,804 A * 6/1997 Remick et al. ..... 124/25.6
5,697,358 A * 12/1997 Campisi ..... 124/88
5,934,264 A * 8/1999 Doornenbal ..... 124/25.6
9,140,513 B2 * 9/2015 Trpkovski ..... F41B 5/0031
2014/0190460 A1 * 7/2014 Langley ..... 124/25.6
2014/0261354 A1 * 9/2014 Ross, Jr. ..... 124/23.1
2014/0360478 A1 * 12/2014 Ady ..... 124/23.1

* cited by examiner

*Primary Examiner* — Joshua Kennedy

(57) ABSTRACT

An Archery Bow, Floating Limb Compound; consists of a riser, giving relative fixed geometric rotational references to a plurality of counter rotating members, each rotating free of relative linier motion and consisting each of a bow string wheel, or eccentric, in common moment with two each, or two pairs each, of control cable wheels, or eccentrics, on each all the same respective axis. Assigned pivotal geometric riser references are a plurality of limbs, or individual limb assemblies, each having each a flexural focus, near the respective pivotal axis, and between two control cable inputs, or pairs of control mounts, one being linked to an adjacent rotating member control, and the other linked to the opposite rotating member's stabilizing cross-feedback control; where together, under draw, the limbs store energy in flexural response to control disproportions; and also pivot, in opposite directions, about each individual limb's, or limb assembly's, pivotal axis, in response to the stabilizing cross feedback.

3 Claims, 8 Drawing Sheets

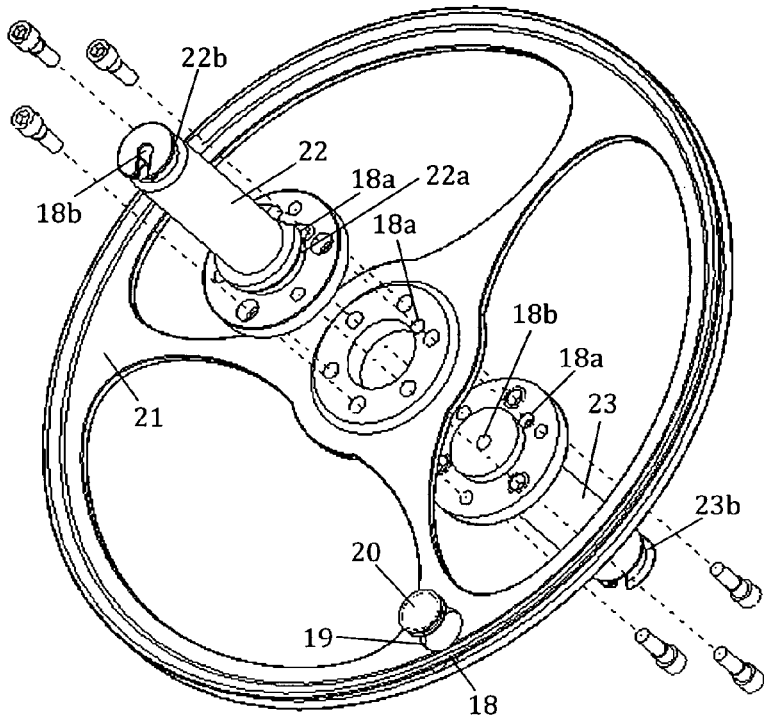
*Fig. 4*
*Fig. 5*
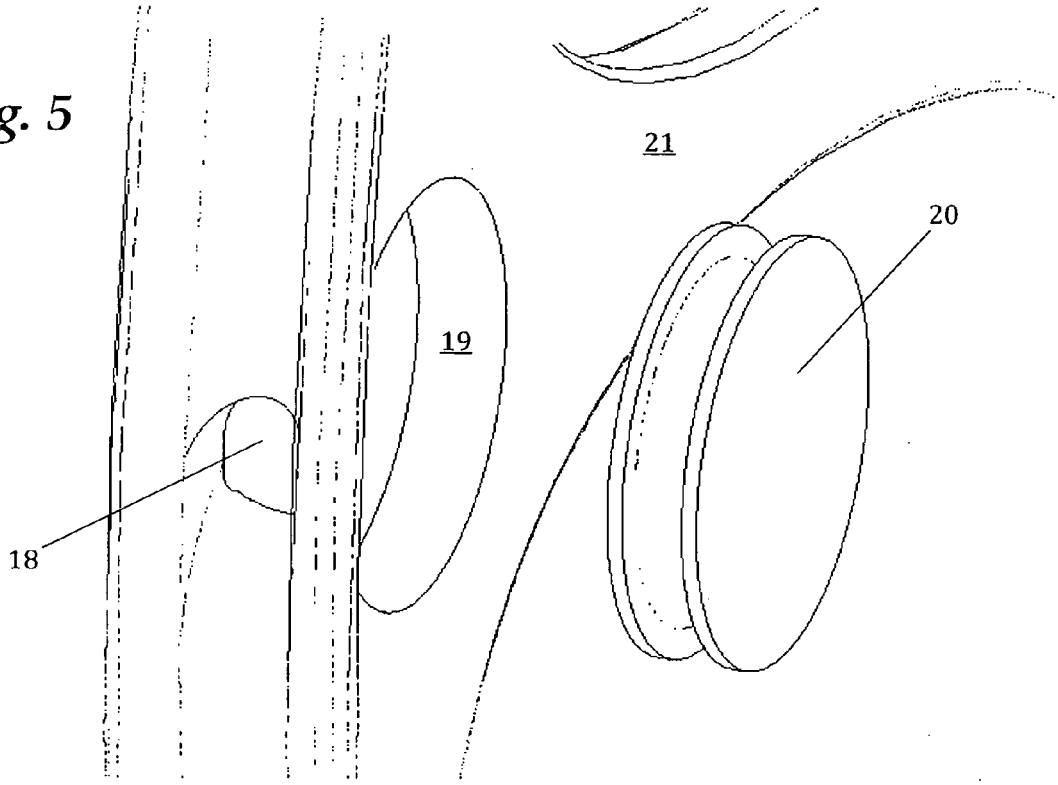

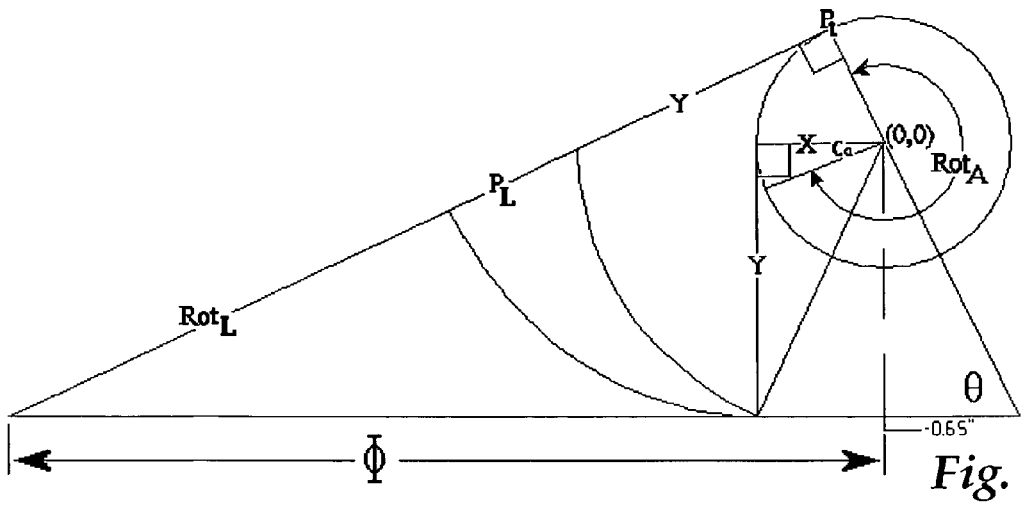

*Fig. 14*

So then where:

Y=ATA-0.65"/2
X=wheel radius"
θ= $P_t$ progression angle
Φ=linear draw to given rotation
( 0,0 )=wheel axis
$C_a$=bowstring clearance angle
$Rot_A$=physical wheel rotation
$P_L$ is the linear expression of $P_t$
$Rot_L$ is the linear expression of $Rot_A$ Then: $(X \cos\theta), ((X \sin\theta) - 1) = (x', y')$ $y'/x' = m \qquad -1/m = (y' - Y) / (x' - \Phi)$ $$\frac{(\sqrt{(x'-\Phi)^2 + (y'-Y)^2}) - (\theta\,(2\pi[X]/360) + [Y])}{(2\pi[X]/360)} = Rot_A$$

and of course that means if: $C_a + Rot_A + \theta = 360$ then: ( Φ+X )+brace"+1.75" = AMO Draw

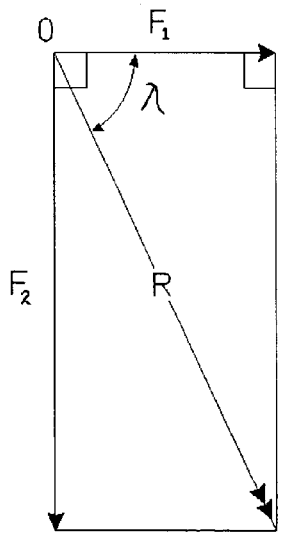

*Fig. 15*

Hooke's Law: the deformation of a body is proportional to the magnitude of the deforming force, provided the body's elastic limit is not exceeded.

( Fig. 15 ) simplified parallelogram of forces example:

$R^2 = F_1^2 + F_2^2$ $\tan\lambda = F_1 / F_2$

ARCHERY BOW, FLOATING LIMB COMPOUND (FLC)

CROSS-REFERENCE TO RELATED APPLICATIONS

This application claims the benefit of provisional patent application No. 61/688,848, filed 2012 May 23.

BACKGROUND OF THE INVENTION

Up until now, with few exceptions, most compound archery bow advances have been layered as refinements of the generalized topology given in Holles Wilber Allen's 1969 "Archery Bow With Draw Force Multiplying Attachments" patent (U.S. Pat. No. 3,486,495), with Arthur J. Frydenlund's 1976 "Compound Bow" (U.S. Pat. No. 3,967,609), being a notable departure at the time, followed closely with a return of focus to the generalized topology of H. W. Allen's work found in Donald S. Kudlacek's 1977 "Compound Archery Bow with Eccentric Cam Elements" patent, (U.S. Pat. No. 4,060,066)

Or basically, two limbs, (or "bow arms") affixed to a riser, with rotating members, (read Bowstring Wheels or eccentrics), affixed to axles at opposite limb ends, each limb receiving negative feedback from the opposite rotating member. Most successful production compound bows have metal clubs on the ends of the limbs.

Of the notable exceptions that have graced mainstream production, few inboard riser mounted eccentric topologies have stood the test of time, as the efficiency of the aforementioned topologies have not been surpassed by an inboard topology. Neither by trading the limb tip mass for the velocity of greater limb travel, nor by lighter limb tip idler wheels and inboard eccentrics, there failing to keep pace by a composite of moving mass and friction found in an excess of moving parts.

The Floating Limb Compound topology, (FLC), is a radical departure, yet clear and concise to pure function, and applicable to competitive mainstream production. Neither inboard nor outboard, this topology possesses potential to surpass the efficiency of all previous vertical hand held compounds and crossbows.

Given the same energy storage, a more efficient bow may be drawn at a lighter weight than a less efficient bow of the same performance, or outperform that same bow of equivalent energy storage. With the more efficient mechanism left to resolve lesser strain, mass may be engineered out of the bow's components, potentially making the bow even more efficient, or may be engineered to shoot a lighter arrow with an equivalent stress proportion resolved by the mechanism. A lighter arrow, receiving equivalent energy, will be faster and have a flatter trajectory, thereby reducing ranging errors and wind drift, or ill anticipation of game.

To say speed is the name of the game in archery is a bit of a misnomer brought about by the IBO spec: 30" AMO draw, 70# peak draw weight, 350 grain weight arrow. As you can see, the constrictions of the specification gives IBO speed as simply "The Product Of"=(Energy Stored×Efficiency). Nevertheless, if an archer purchases a bow by the 1130 speed alone, they certainly will not complain about the speed; but will likely complain about the harshness of the bows draw, lent by its radical energy storage curve, and/or the noise and shock emitted by the bow.

Clearly, efficiency is the truer goal of the archery-engineering professional.

BRIEF SUMMARY OF THE INVENTION

Field of Invention

Hand held compound bow, or compound crossbow, in the field of archery.

The proportion of energy imbibed in the moving components of a bow cannot escape the bow, upon the shot cycle, by any other means than shock, noise, and heat. An increase in compound bow efficiency requires a decrease in the bow's component moving mass and friction; that, of the energy put into the bow, a greater proportion finds resolve in an arrow of equivalent mass. In general, the Floating Limb Compound topology accomplishes this in freeing the limb ends of the rotary mass. This by assigning both the wheels, or eccentrics, and limbs, to separate fixed riser locations; with each limb given a pivotal axis, and generative and degenerative inputs set to opposite limb ends. As such, the limbs take on a mild rotary component; and there also, find duty as eccentrics to the draw force curve.

All FLC design examples pictured in this document are from developmental stages of the Earth Synergetics UnderDog-FLC, in its vertical hand held form, (currently no plans for a crossbow version). And as such, of an ambidextrous riser casting where the entire assembled bow is simply flipped for a right or left handed shooter. Contrary to tradition, a left handed shooter will load their arrow into the left side of an ES UnderDog FLC, and a right handed shooter will load their arrow into the right; mostly because it just works better like that when the arrow rests under the archers bow hand.

Yes, the bow hand goes over the arrow and the arrow goes under the bow hand.

These departures from tradition are not the primary claim of this patent. This is just the way the ES UnderDog-FLC is, and for plenty of reasons I may get into later; but for now, consider it best to step beyond these oddities, and set them as trivial for the moment.

BRIEF DESCRIPTION OF THE DRAWINGS

These and other features of the FLC design will become more apparent from the following description in which reference is made to the appended drawings wherein:

FIG. 4 shows an exploded wheel assembly, and introduces the series of reference numbers, (19, 18, 18*a*, 18*b*), pertaining to holes, or absence; but nonetheless provide critical function in mounting the "through-pass pseudo double bus" control cables, and for a light and strong bow string mount, at nearly the fastest moving part of the bow.

FIG. 5 shows a close up of a "bow string button" and associated receiving area of a (21)

FIG. 14 shows graphically the applied math symbols used for calculating draw off fixed wheels.

FIG. 15 simplified parallelogram of forces.

Figure 1:
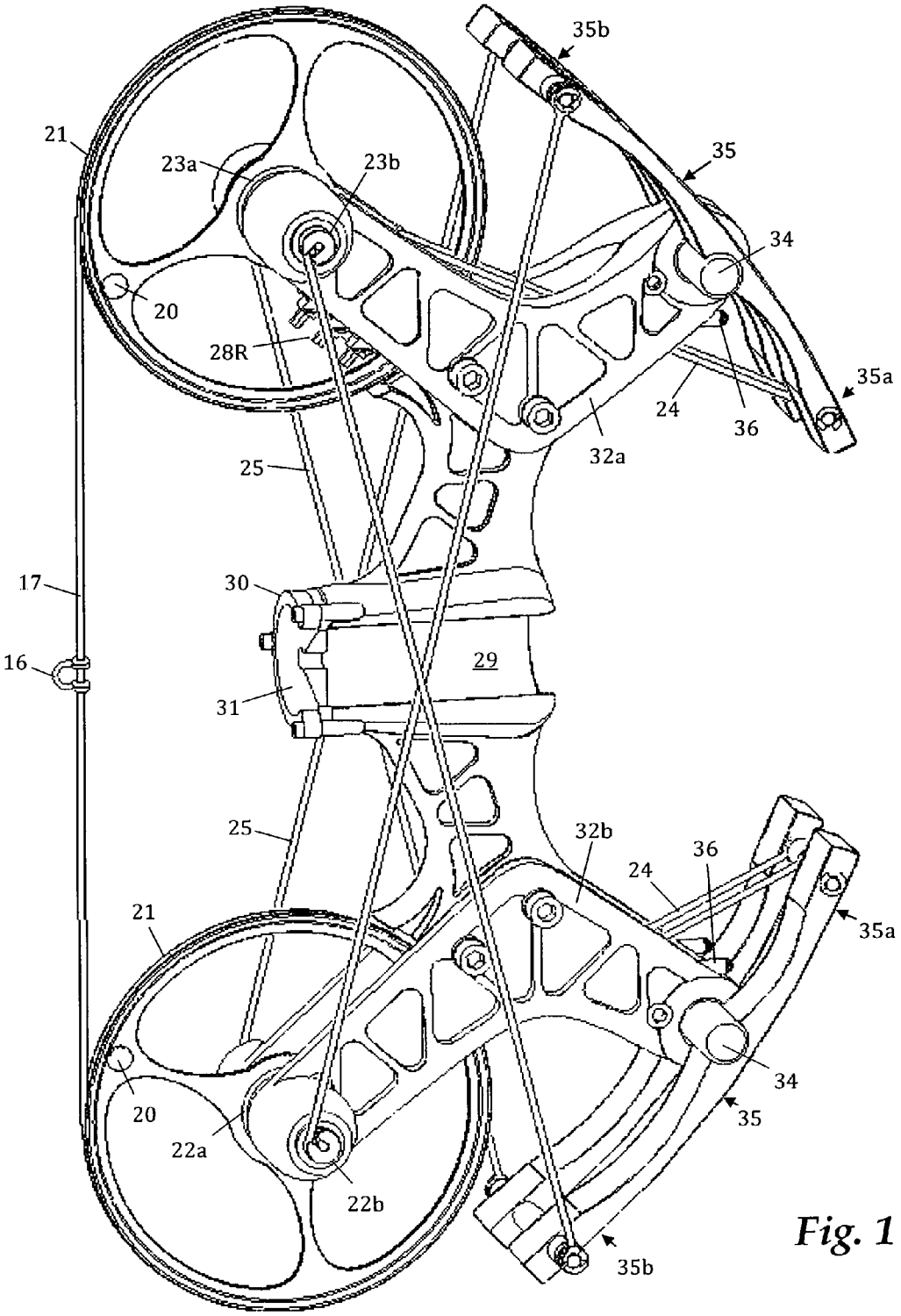
FIG. 1 shows the example FLC bow in a full single perspective view, in right hand orientation; and is labeled with reference numbers that lend to this view.

DRAWINGS: REFERENCE NUMERALS (16) string loop for release aid, (the UnderDog-FLC is 13" ATA, and cannot be shot finger style).
(17) synthetic bowstring
(18) bowstring loop through pass hole
(18*a*) "pseudo double bus" in-feed control cable through pass hole
(18*b*) "pseudo double bus" out-feed control cable through-pass hole
(19) bowstring button socket
(20) bowstring button
(21) bowstring wheel
(22) top/left, and bottom/right, half-axle (of mirror design to (23))
(22*a*) in-feed control cable wheel, (of 22) mirrored half-axles
(22*b*) out-feed control cable wheel, (of 22) mirrored half-axles
(23) top/right, and bottom/left, half-axle (of mirror design to (22))
(23*a*) in-feed control cable wheel, (of 23) mirrored half-axles
(23*b*) out-feed control cable wheel, (of 23)(mirrored half axles
(24) one of two synthetic in-feed control cables (shorter than bowstring)
(25) one of two synthetic out-feed control cables (longer than bowstring)
(26) one of eight wheel bearings
(27) one of two sighting channels in the main riser casting
(28R) right-handed sighting pin set and rail
(28L) left handed sighting pin set and rail
(29) Main riser casting
(30) Retainer for arrow rests of the 2-inch disk standard
(31) 2-inch disk compliant arrow rest
(32*a*) riser bolt plate-top plate in RH orientation, bottom plate in LH orientation
(32*b*) riser bolt plate-top plate in LH orientation, bottom plate in RH orientation
(33) one of two limb pivot bushings
(34) one of two limb pivots
(34*a*) one of two limb pockets per limb pivot
(35) one of two limb assemblies
(35*a*) in-board limb assembly end
(35*b*) out-board limb assembly end
(35*c*) mating limb pocket relief, one of two per (35)
(36) Fixed draw stops, one, or two, of four

DETAILED DESCRIPTION OF THE INVENTION

Figure 2:
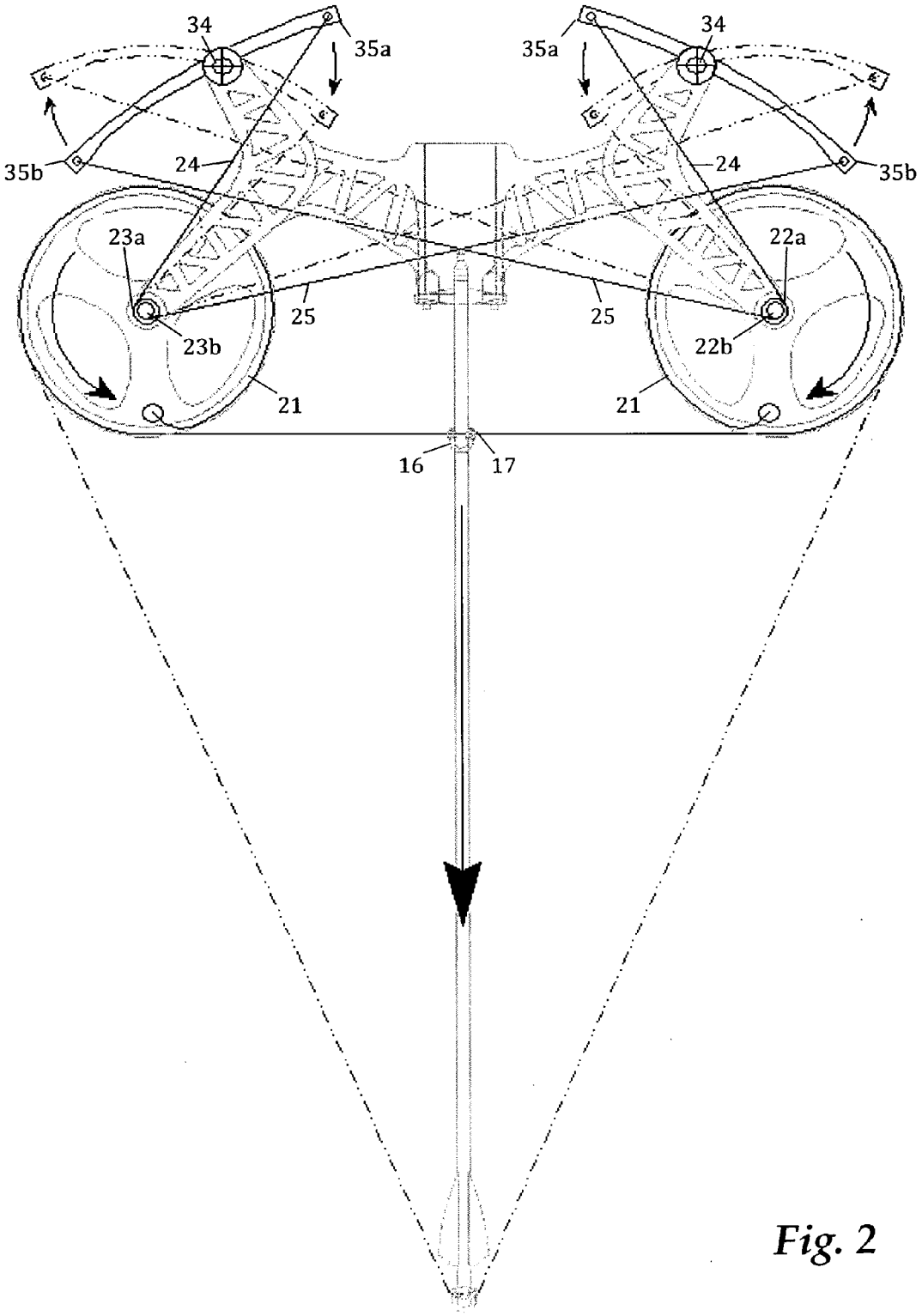
FIG. 2 shows a simplified, two dimensional, draw cycle operation diagram. It is labeled with relevant reference numbers, with (23*x*,22*x*) in a same side adaptation.
Figure 3:
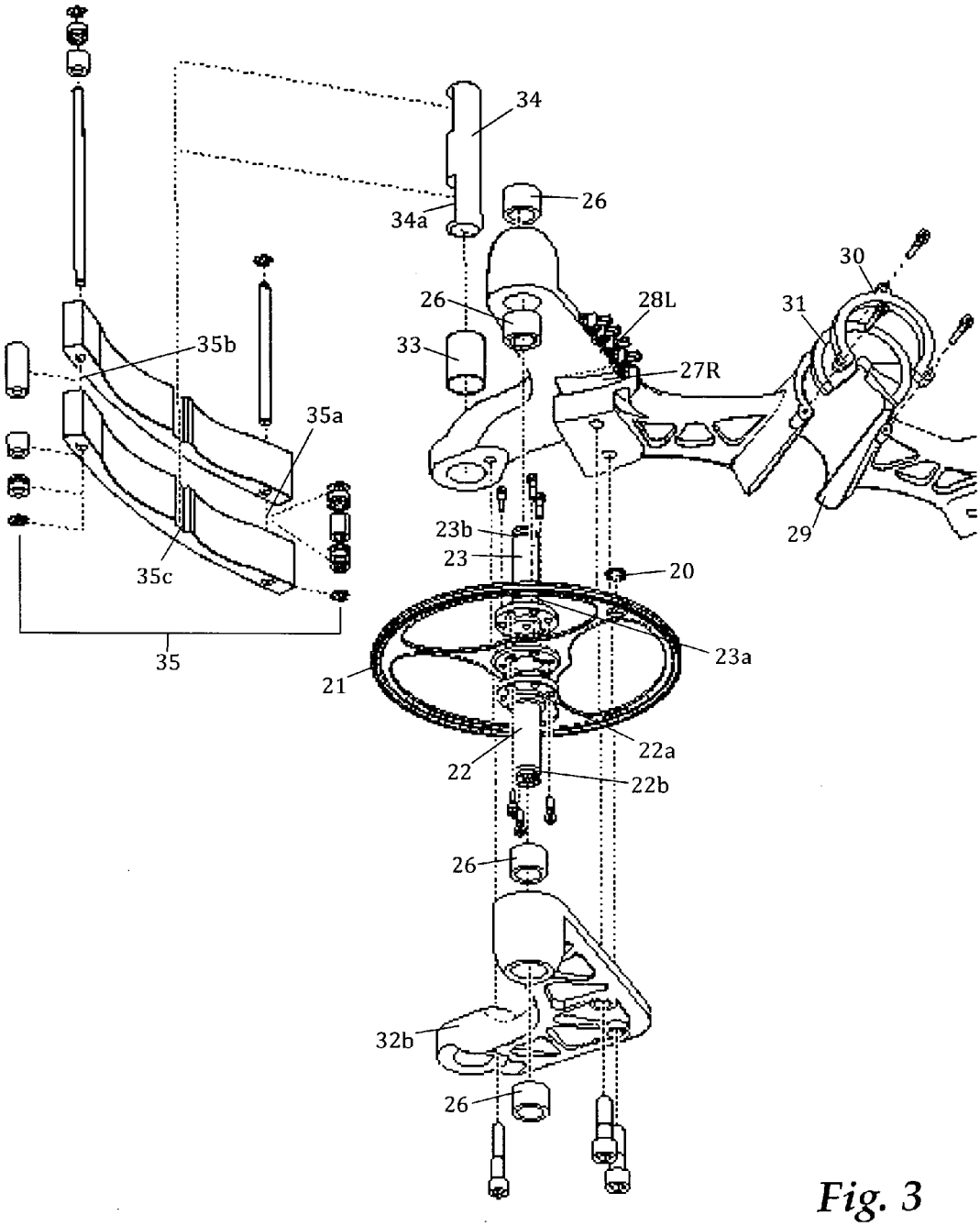
FIG. 3 shows a sideways exploded view of the top half of the bow in left-handed orientation, or the bottom in right-handed orientation. All top/bottom reference numbers transpose except (32*b*, 32*a*) and (27*x*,28*x*), though some reverse position left to right when transposed.
Figure 6:
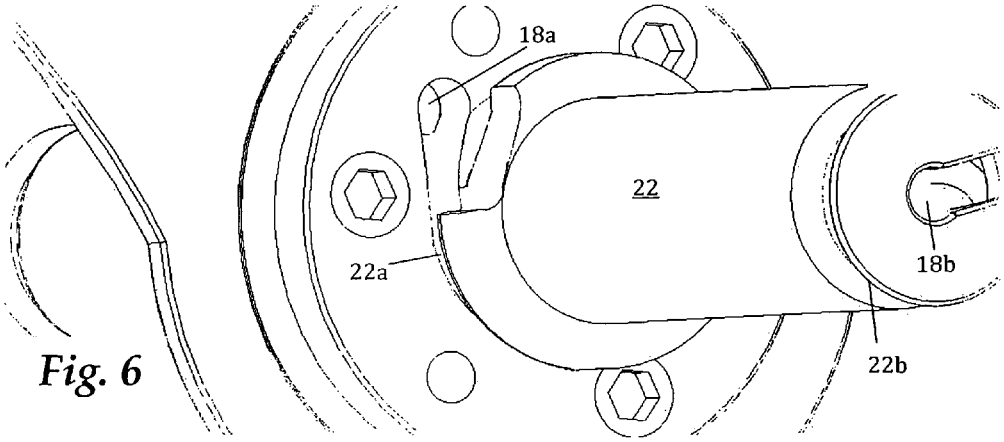
FIG. 6 shows a close up featuring the in-feed wheel (22*a*), and control cable pass through holes (18*a*, 18*b*), of a (22) mirror half-axle.
Figure 7:
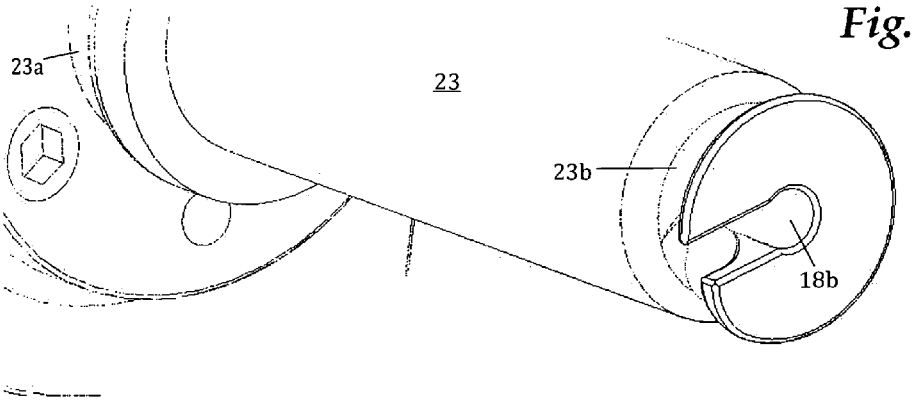
FIG. 7 shows a close up featuring the out-feed wheel (23*b*), and out feed control cable pass through (18*b*), of a (23) mirror half-axle.
Figure 8:
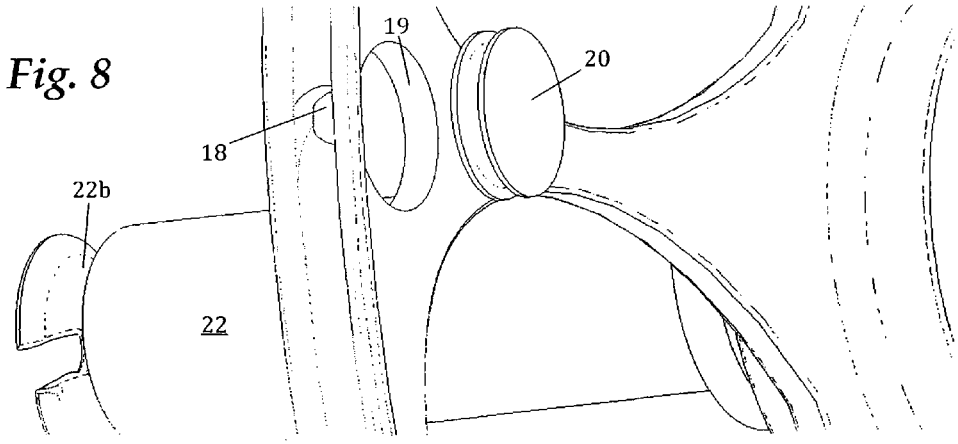
FIG. 8 shows the left side orientation of a (22) mirror half-axle in relation to a (bow string wheel's downward facing (18).
Figure 9:
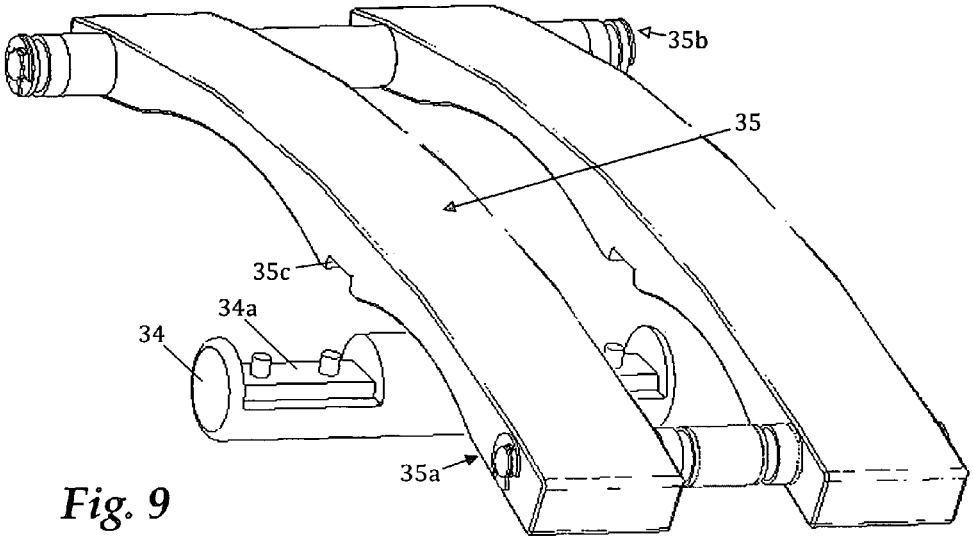
FIG. 9 shows a limb pivot socket (34*a*), and hints at (35*c*), machined in negative to it. Both end loops, of each control cable, mount to the respective limb pin by a standard archery convention.
Figure 10:
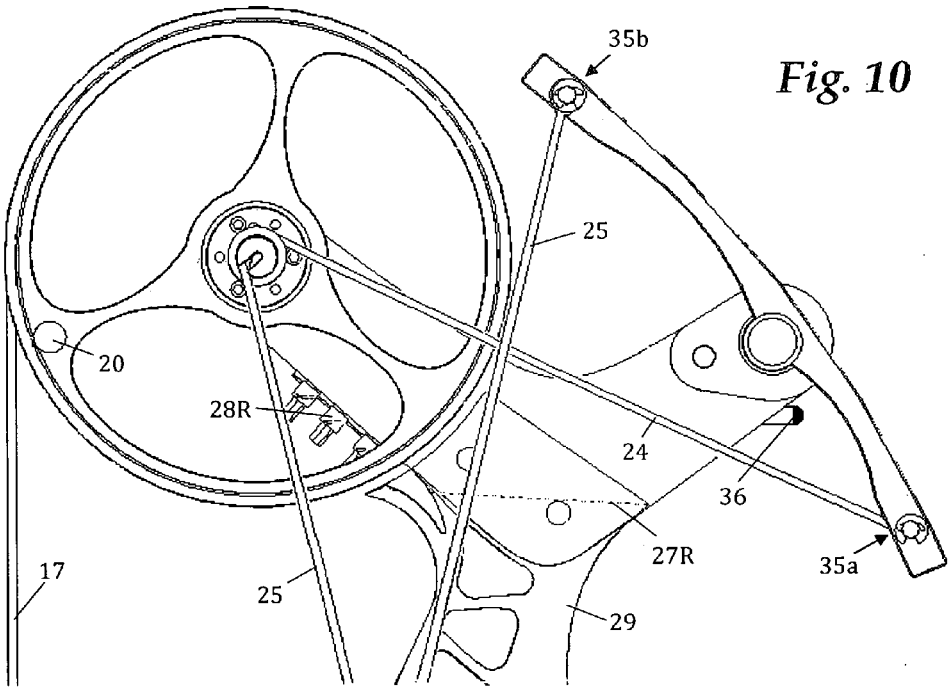
FIG. 10 shows a fictitious assembly in absence of the supporting bolt plate (32*a*), in order to assist in visualizing the (central passage that passes 24) through its range of motion, and also gives a phantom line to show the bottom of that end's sighting channel (27R).
Figure 11:
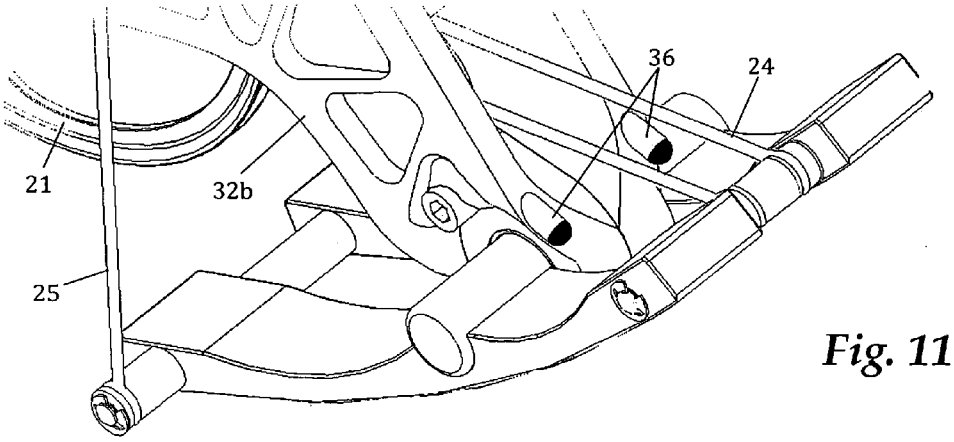
FIG. 11 shows a (close up featuring one limb assemblies' fixed draw stops 36), adjusting the draw length of an Under-Dog-FLC is done by twisting or (untwisting 24), and draw weight adjustments by twisting or (un-twisting 25).
Figure 12:
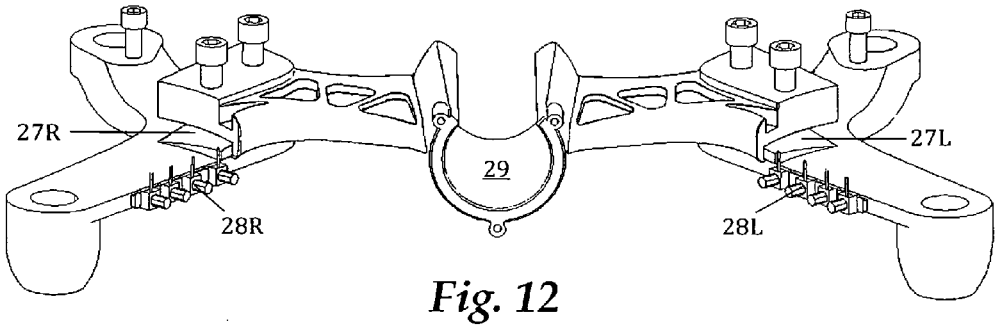
FIG. 12 shows a riser casting (29) mounted with both left-handed and right-handed targeting pin sets, and also gives view to the opening of both left and right sighting channels (27R,27L).
Figure 13:
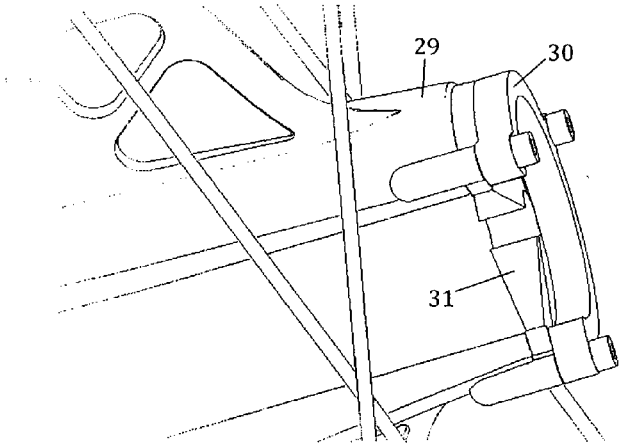
FIG. 13 shows a close-up featuring the compact, and structurally advanced receiver for arrow rests that comply to the "two inch disk standard".
Figure 13:
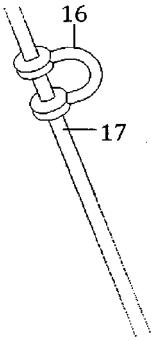

Grasping the basic two dimensional concept, at first, seems most digestible for the unfamiliar. (FIG. 2) is to be seen as a double exposure: position at brace, or un-drawn, in solid line; and the full draw position shown in phantom lines with arrows indicating components motion to this end. Of course the shot cycle is simply of reverse vectors, but too fast to visualize clearly; so we will focus on the draw cycle here, as the shot cycle clearly can thereafter be assumed.

Envision each of the two wheel assemblies; individually, as three concentric wheels common of axis and moment. Each assembly then, (as one large bow string wheel 21), with two much smaller, yet disproportionately so, control cable wheels; the in-feeds (23*a*, 22*a*), and smaller still, the out-feeds (23*b*,22*b*). Start at brace, or un-drawn, and note the direction of rotation of each wheel, as imparted by the (bow string 17). The larger of the inner control cable wheels (23*a*, 22*a*) is then drawing each inboard limb tip (35*a*), toward its neighboring wheel assembly under draw via the (synthetic in-feed control cables 24). While then also the smaller control cable wheels (23*b*,22*b*) leave off slack into the (synthetic out-feed control cables 25) to be absorbed by the outboard limb tip (35*b*) of the opposite limb assembly in relation to each wheel.

Note the limb deflection, and consequent energy storage, is in relation to this control wheel disproportion, and also, the limb ends' (35*a*,35*b*) liner disproportion in angular deflection to (each limb pivot 34). This limb rocking degenerative feedback locks the system into a congruous whole. This can be confirmed by mentally trying to move one wheel while allowing the rest of the bow to react. Note also, the changing moments of torque, approximated as the control cable angle of incidence in perpendicular construct to the limb pivots. Likely this dynamic will continue to be predominantly what gives an FLC the humped up, and flattened, draw force curve; gifted to traditional compound design by pioneers of the earlier, and more modern, cammed compounds.

Many of today's archery design professionals possess a level of technical excellence and mathematical prowess and fluency far beyond mine. To them, mine will be a simple bow, however well thought, however efficient, however fast, just as simple.

Though complex, I suppose by shift of convention to that which is simply unfamiliar, for the approach, by necessity, has to be much different. First order, by my thoughts, was sorting the dynamics of draw off fixed wheels.

In reference to (FIG. 14) which, as half mirror to the two dimensional geometry; and with the following expressions in Cartesian trigonometry, gives limb forces, in liner translation to the archer, in terms of degrees of rotation, with any optional added eccentricity as +/− to a nominal. But what limb? By what angles? Through what control wheel diameters?

Ok, so it is somewhat complex. Though not so much the control cable wheels, quite simple there. I just designed the smallest Out-Feed, (termed by action during the draw cycle), wheel I could manage, and adjusted the size of the In-Feed, (same term reference), to properly convey my imaginary limbs.

Imaginary limbs, or no imaginary limbs, the control cable wheels are by far the best place to put it all together front to back, as the minor sizing adjustments only alter the control cable angle to the limb ends by a miniscule degree.

So the limb translation into the control cables is next. You could run parallelogram of forces (FIG. 15) until your blue in the face while you move around the limb pivot and play with lengths. However, if you simply run perpendicular constructs from the control cables to the limb pivots, you end up with a simple mechanical advantage ratio you can use to translate the composite force of a deflection figure, and ball park placement and orientation will go much faster. Then pull out the parallelogram of forces trigonometry for the hone, with an eye toward bringing it all together at the control cable wheels.

There are down sides to the FLC topology, where in whatever other configuration, I would think similes would yet remain. And so, specifically of my example design, and deserving of mention:

One, (1)—The predisposition of the outboard limb ends to bounce slack into the out-feed control cables at the end of the shot cycle. So minimizing the potential of inertia there is of concern. Although that down side also has the up side of forcing inertial considerations that should be made anyway, and also giving a portion of the bows energy a place to go at the end of the shot cycle, that does not inflict stress into the structure.

The other, (2), is/are, the two sides of a limb travel "Red Zone" where danger of "Snap Over" looms. As archers are accustomed to "twist, and un-twist" tuning, and sometimes tend to push limits, this also is of a primary concern. Obviously, the limbs must be constrained to their safe reign of operation, though I feel a well-designed FLC could be trustingly left to an archer to maintain within a clearly specified safe range of tune.

Since the critical heavy wrist bone brace of an UnderDog-FLC requires the grip be of a snug vertical fit, I am planning to offer three scaled out ambidextrous risers, with two wheel sizes for each riser, a couple of alternate half axle sets, and a wide assortment of limbs.

I likely will not sell rights. As Eric William Koch by birth stamp has, over time, become known to many as Rulgert the Tree Saucer Builder, (apprentice of Tom Chudleigh the Tree Sphere builder), and though building compound bows isn't really my job, every Tree Saucer dweller does need a compound bow as I see it; so I might just as well build bows too. Besides, the UnderDog-FLC is The Tree Saucer bow, and quite specifically designed as such. Though a work in progress, as are the Tree Saucers yet, mostly due to myself being a somewhat financially challenged, non-profit creative professional here at the helm of Earth Synergetics LLC. earthsynergetics.com

The invention claimed is:

1. A Floating Limb Compound Archery Bow: comprising:

a riser, defined by a rigid structure which forms a fixed geometric reference to which every component of said bow is oriented in a functional geometric relationship, a bowstring, a plurality of counter-rotating members mounted to said riser, said counter-rotating members being of mirrored design, which each similarly transform imparted torque moments between one side of the bowstring, an in feed control bus, and an out feed control bus, all individually fitted to each said rotating member, which maintains said bowstring and each said control bus, in a predetermined disproportionate radius with concern to each said rotating member's common axis, as a wheel or as static definition of an eccentric;

a plurality of pivoting limb assemblies mounted to said riser, each pivoting limb assembly comprising:

two control bus inputs, with an input at an out-board limb end and an in-board limb end, and a flexural focus, near a respective pivotal axis, located between said control bus inputs, a plurality of in-feed and out-feed control cables, wherein the in-feed control cables conjoin a respective in-feed control bus of said counter-rotating members with a respective in-board limb end and the out-feed control cables conjoin a respective out feed control bus with a respective out-board limb end on an opposite limb assembly, together forming a negative feedback loop that locks said bow into a counter-rotational unison, where four pivoting limb force vectors translate by dynamic angle of incidence to the four said control buses which translate to composite torque moments each through one of said plurality of rotating members as equally conveyed to said bowstring in defining a given draw force curve.

2. An Ambidextrous by Flip, Opposite Side Loading, Underhand Shot vertical hand-held archery bows, comprising:

a centrally located, generally "c-shaped" arrow rest;

grip members extending from upper and lower portions of the arrow rest such that the riser is symmetrical about a horizontal plane extending through the arrow rest such that the riser can be flipped 180 degrees, with respect to a central axis of the arrow rest, for the purpose of accommodating both left and right handed shooters, thus said Ambidextrous by Flip, via the grip members on either opposite side of the arrow rest;

the grip members having a rear face extending forwardly at an angle from a generally rear portion of the arrow rest and forming a crotch area located distally from the arrow rest such that an archers bow hand is capable of being located on the grip above the arrow rest, providing the underhand shot aspect, moving heavy wrist bone pressure from a lower portion of an archers wrist, closer to the central axis of the arrow rest; and wherein the riser is arranged such that a left handed shooter will load an arrow into the left side of the riser, and a right handed shooter will load their arrow into the right side of the riser, thus said Opposite Side Loading.

3. A bowstring end loop mount comprising:

a bowstring button; and a rotating member having a peripheral bowstring channel and mating surfaces in negative to the button;

wherein a bowstring end loop is capable of being passed through a hole that has been machined in arcing radial plunge from the peripheral bowstring channel of the rotating member through the side of a larger, slightly coved, bore made inboard through the rotating member in parallel to the rotating member's rotational axis;

the bowstring button comprising a small and thin disk being clearanced to fit within said larger bore, and having a concentric peripheral groove capable of accepting a bowstring end loop therein, wherein the button is capable of being inserted into the string loop at a location outside the larger bore; the button and string loop assemblage is then pushed into the larger bore as the bowstring is being pulled taught, thusly setting mechanical fixation of the bowstring end loop to the rotating member.

* * * * *